US006105509A

United States Patent [19]

Altfeder

[11] Patent Number: 6,105,509

[45] Date of Patent: Aug. 22, 2000

[54] GARDEN BENCH

[76] Inventor: Cheryl L. Altfeder, 114 Lockwood E. Dr., Cary, N.C. 27511

[21] Appl. No.: 09/345,360

[22] Filed: Jul. 1, 1999

[51] Int. Cl.[7] ..... A47B 23/00

[52] U.S. Cl. ..... 108/42; 108/134; 248/290.1

[58] Field of Search ..... 108/42, 47, 134, 108/108; 248/240, 240.3, 240.4, 290.1, 308

[56] References Cited

U.S. PATENT DOCUMENTS

| | | | |
|---|---|---|---|
| 443,369 | 12/1890 | March | 108/42 |
| 3,035,709 | 5/1962 | Weiss | 108/134 |
| 3,187,692 | 6/1965 | Ross | 108/47 |
| 4,889,057 | 12/1989 | Chartrand | 108/42 |
| 5,143,337 | 9/1992 | Tomayko, Jr. et al. | 248/240.4 X |
| 5,158,023 | 10/1992 | Allen | 108/42 |
| 5,528,993 | 6/1996 | Vincelli | 108/42 X |
| 5,802,647 | 9/1998 | Helmsdefer | 108/42 X |

FOREIGN PATENT DOCUMENTS

| | | | |
|---|---|---|---|
| 2703276 | 8/1978 | Germany | 108/134 |
| 212649 | 3/1924 | United Kingdom | 108/134 |
| 769051 | 2/1957 | United Kingdom | 108/134 |
| 859472 | 1/1961 | United Kingdom | 108/134 |

*Primary Examiner*—Peter R. Brown
*Assistant Examiner*—Hanh V. Tran
*Attorney, Agent, or Firm*—Coats & Bennett, PLLC

[57] ABSTRACT

A collapsible workbench mounts to a wall and is movable between a deployed position and a storage position. A support structure is secured to the wall for supporting the bench in a generally horizontal deployed position. The support structure allows the bench to be detached from the wall or, alternatively, folded down to a storage position adjacent to the wall.

8 Claims, 3 Drawing Sheets

GARDEN BENCH

FIELD OF THE INVENTION

This invention pertains generally to workbenches and, more particularly, to a gardening bench suitable for attachment to a wall that can be easily dismounted or folded against the wall when not in use.

BACKGROUND OF THE INVENTION

Gardening is one of the most popular activities in the United States. When gardening, it is usually convenient to have a workbench for doing various gardening tasks, such as potting plants. The workbench allows the gardener to stand comfortably while working and helps maintain tools and materials that are needed within easy reach. Unfortunately, there are not many workbenches available that are made specifically for gardening. Consequently, many gardeners simply make do with a generic, multi-purpose workbench.

One problem with using a generic, multi-purpose workbench for gardening is that it does not always provide a convenient place to store gardening tools or other materials (e.g., potting soil, mulch, fertilizer, etc.) that may be needed for gardening. Consequently, the work surface tends to get cluttered with gardening tools and other materials during use. The gardener can purchase a separate storage closet or rack in which to store the gardening tools. This alternative requires additional expenditures. Also, a separate storage closet or storage rack consumes precious space that could be used for other purposes.

Another problem is that many people do not have sufficient space for a freestanding workbench. For example, many people live in apartments or homes without a garage or workshed. People so situated will frequently fashion a workbench out of whatever materials may be available or will make do without a bench. The lack of a suitable place to work, however, tends to discourage those people from engaging in gardening.

Another problem is that potting soil, organic matter, and mulch is frequently spilled on the bench. Conventional workbenches have a solid work surface that become quickly dirtied and must be cleaned up after use.

Accordingly, there is a need for a workbench that is specifically adapted for gardening and that consumes as little space as possible.

SUMMARY OF THE INVENTION

The present invention is a workbench that is specifically designed for gardening. The workbench is designed to mount to a wall so that a minimal amount of space is required for use. The bench may be folded down against the wall or dismounted from the wall for storage as desired. The bench also provides a convenient place for storing gardening tools for easy accessibility.

The bench comprises a generally planar, perforated work surface surrounded by a frame. The work surface hangs from a pair of support hooks that are mounted to the wall. A pair of triangular supports extend from the bottom of the work surface and butt against the wall to support the work surface in a horizontal position. When not in use, the triangular supports can rotate inwardly against the bottom side of the work surface and the entire work surface can fold down against the wall. Also, the work surface can be lifted up and removed entirely from the hooks, so that the work surface can be stored in a closet or other out-of-the-way place. In the latter instance, the hooks are designed to pivot and lie flat against the wall. This prevents inadvertent injury by hiding the protruding portion of the hook.

Other advantages and functions will become readily apparent to those of ordinary skill in the art upon reference to the following detailed description and the accompanying drawing figures.

DETAILED DESCRIPTION OF THE PREFERRED EMBODIMENT

Figure 1:
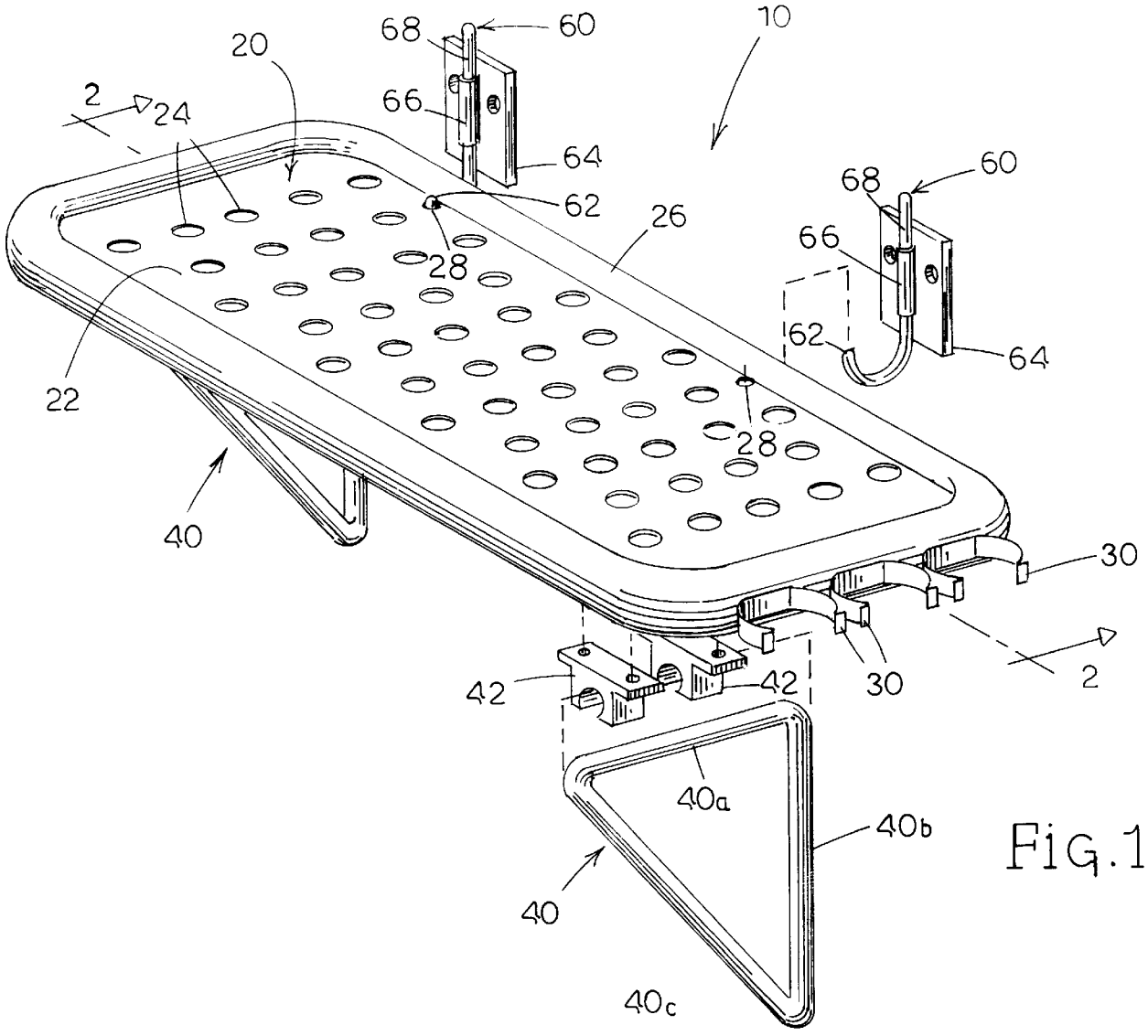
FIG. 1 is an exploded perspective of an exemplary embodiment of the present invention.

Turning now to the drawings, FIG. 1 shows an exemplary embodiment of a gardening bench, indicated generally by the numeral 10. The gardening bench 10 comprises a bench 20, triangular supports 40, and a pair of support hook assemblies 60.

Figure 2:
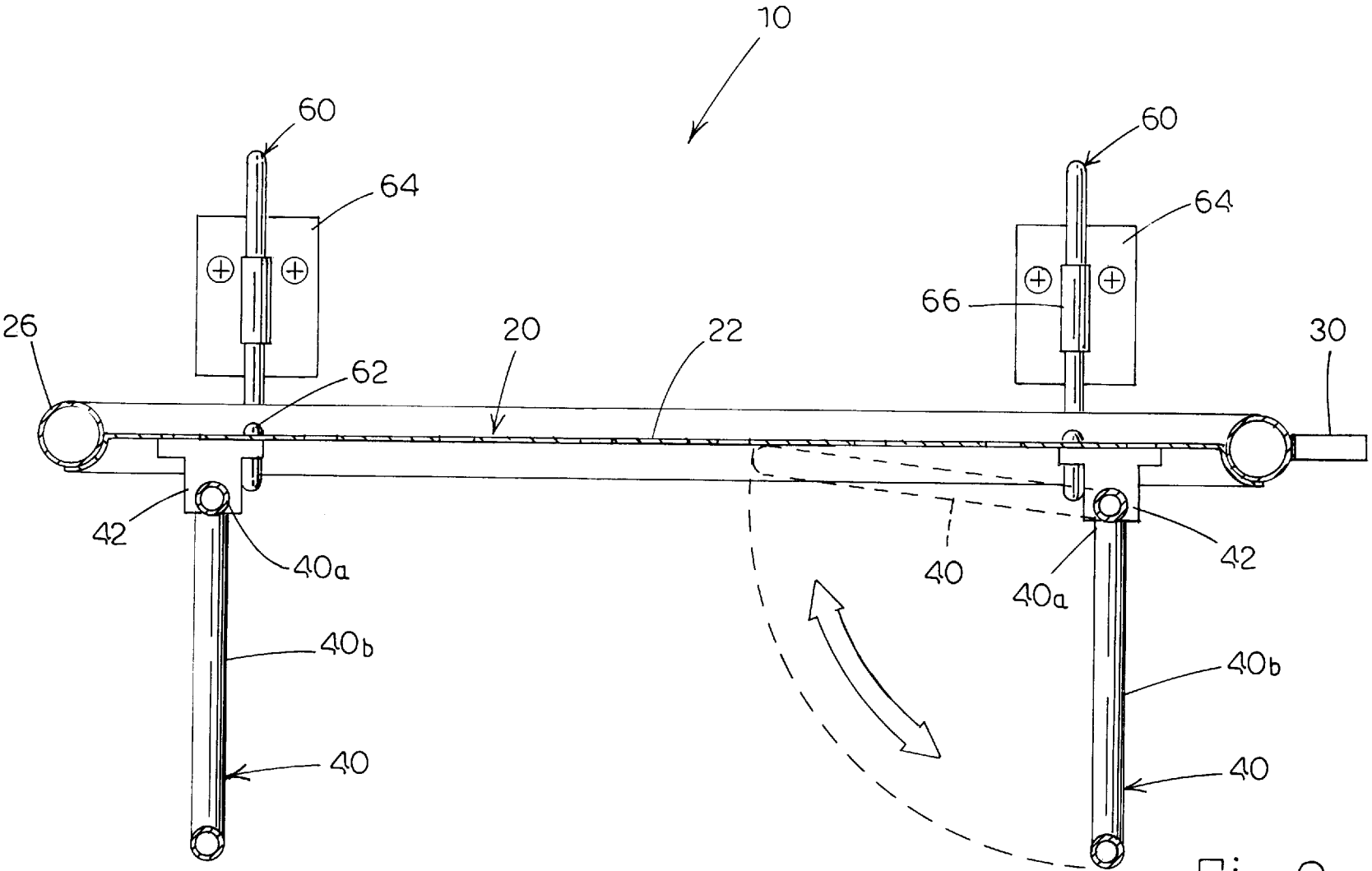
FIG. 2 is a cross-section along lines 2—2 of FIG. 1.
Figure 3:
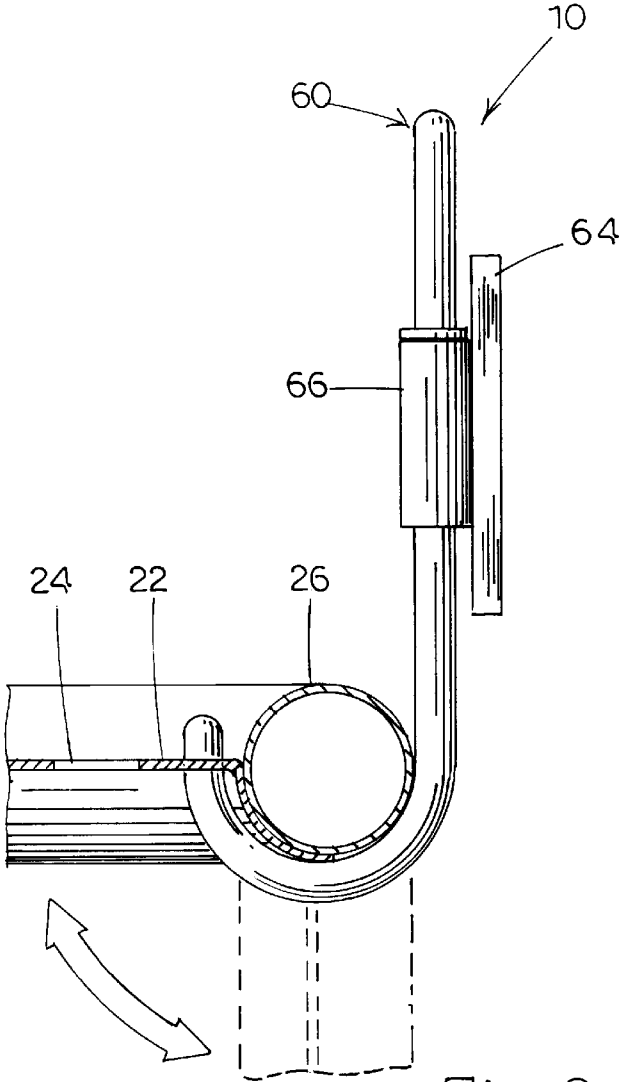
FIG. 3 is a cross-section of the work surface of the present invention suspended on a hook.

Bench 20 includes a planar work surface 22 having a plurality of apertures 24, which allow soil and water to fall through work surface. Work surface 22 is surrounded by tubular frame 26, which is preferably contiguous with the work surface 22 (FIGS. 2 and 3). A pair of openings 28 are formed in the work surface 22 along the back edge thereof to engage the support hook assembly 60 as will be hereinafter described. Attached to one end of frame 26 are a plurality of c-shaped tool clamps 30, which are spring-like and act to hold tools (not shown) between use. While three clamps 30 are shown, it is within the scope of the present invention to provide different numbers of clamps 30 as desired by the user. Likewise, while only shown on one end of workbench 20, it is within the scope of the present invention to provide clamps 30 on both ends.

The triangular supports 40 are secured to the underside of the work surface 22 (FIGS. 1 and 2). The triangular supports 40 include a horizontal member 40*a* that is generally parallel to the work surface, a vertical member 40*b* that is perpendicular to the work surface 22 and generally parallel to the wall, and an angled member 40*c* that connects the horizontal and vertical members 40*a* and 40*b*. The triangular supports 40 are secured to the underside of the work surface 22 by support clamps 42. Alternatively, the triangular supports could be mounted to the wall. Support clamps 42 are rigid brackets secured by any suitable fastener, such as screws or bolts to the underside of the work surface 22. The horizontal member 40*a* of the triangular supports are received in respective support clamps 42. The triangular supports 40 rotate in the clamps 42 between deployed and storage positions. In the deployed position, the triangular supports 40 extend vertically downward from the bottom of the work surface 22. In this position, vertical members 40*b* of the triangular supports 40 abut the wall or other vertical surface (not shown) and prevent bench 20 from rotating downward as will be explained in greater detail below. In the storage position, the triangular supports 40 are rotated upwardly against the underside of the work surface 22. If mounted to the wall, the triangular supports would rotate about a vertical axis and would lie against the wall in the storage position. When triangular supports 40 are in the storage position, bench 20 may be rotated downwardly to lie against the wall or other vertical surface while still supported by the hook assemblies 60, as seen in FIG. 3. This allows unobtrusive storage of bench 10 when not in use.

Figure 4:
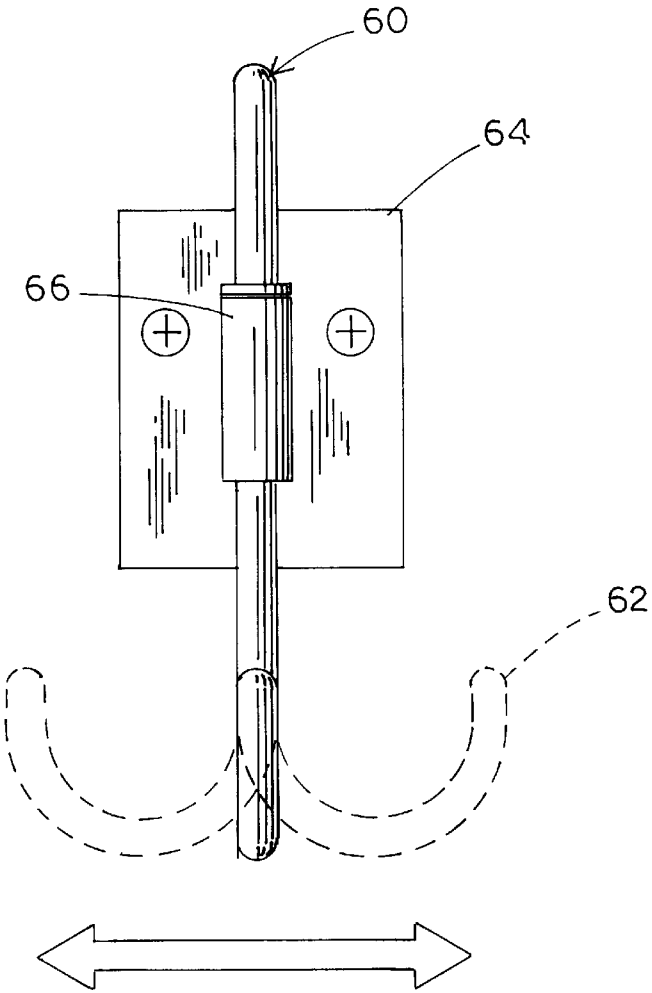
FIG. 4 is a front elevation of the hook assembly used to mount the work surface to the wall.

Each support hook assembly 60 comprises a support hook 62 and a mounting bracelet 64. The mounting bracelet 64 includes a sleeve 66 which receives the shank of the hook 62. The hook 62 rotates in the sleeve 66 as shown in FIG. 4. The hook 62 rotates between a deployed position (shown in solid lines in FIG. 4) and a storage position (shown in dotted lines). In the deployed position, the hook 62 extends outward from the wall. In the storage position, the hook 62 lies flat against the wall.

To use the garden bench 10, hook assemblies 60 are secured to a wall or other vertical surface (not shown) by means of conventional fasteners such as screws, bolts or the like. Hooks 62 are rotated to the deployed position. Bench 20 is then suspended from hooks 62 by positioning apertures 28 over the curved portions of hooks 30. Triangular supports 40 are folded downwardly from the storage position to a deployed position so that vertical portion 40*b* abuts the wall and supports the work surface 22 in a horizontal position. The user (not shown) may now use the bench 20, inserting and removing tools (not shown) from tool clamps 30 as needed.

When not in use, the bench 10 can either be folded down against the wall or dismounted completely for storage in a remote location. In either case, the user folds the triangular supports 40 to the storage position, flush against the bottom of the work surface 22. The bench 20 can then be folded down against the wall to a storage position, or lifted up off of the hooks 62 and moved to some other location for storage. In the later case, the hooks 62 can be rotated to a safety position against the wall.

The present invention provides a workbench that is specifically designed for gardening and includes holders for the gardening tools. One advantage of the present invention is that the bench 20 mounts to a wall and may be collapsed for storage. Alternatively, the bench can be removed from hooks 30 and carried to another location for storage or further use. Thus, the bench is ideally suited for situations where there is not sufficient space for a freestanding bench.

The present invention may, of course, be carried out in other specific ways than those herein set forth without departing from the spirit and essential characteristics of the invention. The present embodiments are, therefore, to be considered in all respects as illustrative and not restrictive, and all changed coming within the meaning and equivalency range of the appended claims are intended to be embraced therein.

I claim:

1. A collapsible bench adapted to be mounted to a wall, comprising:

a) a bench having a top, bottom, and a plurality of sides; and b) a support structure adapted to be secured to the wall for supporting the bench in a generally horizontal deployed position and permitting the bench to be detached from the support structure or folded down to a storage position adjacent to the wall wherein the bench remains to be supported by the support structure, said support structure comprising i) a mounting bracelet including a planar portion and a sleeve, said planar portion adapted to be affixed to the wall, and ii) a generally j-shaped support hook including a shank and an upwardly curved portion for engaging the bench at an inner portion of said upwardly curved portion, said shank received within said sleeve and rotatable therein about a vertical axis such that said hook may be rotated about an arc of approximately 180 degrees to lie flush against the wall on either side of the sleeve and may additionally be positioned generally normal to the plane of the wall such that the bench may be removably positioned on said upwardly curved portion.

2. The collapsible bench according to claim 1 further comprising a support member being secured to the bottom of the bench and rotates against the bottom of the bench in the stowed position.

3. The collapsible bench according to claim 1 further including one or more tool supports mounted along a side of the work surface.

4. A folding workbench comprising:

a) a work surface having a top, a bottom, and a plurality of sides;

b) a wall mounted support for rotatably mounting the work surface to a wall or other vertical surface so that the work surface is movable between a generally horizontal deployed position in which the workbench extends generally perpendicularly from the wall and a storage position in which the workbench is folded down against the wall, said workbench being removable from said wall-mounted support, said wall mounted support comprising:

i) a mounting bracelet including a planar portion and a sleeve, said planar portion adapted to be affixed to the wall or other vertical surface, and ii) a generally j-shaped support hook including a shank and an upwardly curved portion, said shank received within said sleeve and rotatable therein such that said hook may be rotated about an arc of approximately 180 degrees to lie flush against the wall or other vertical surface on either side of the sleeve and may additionally be positioned generally normal to the plane of the wall such that the work surface may be removably positioned on said upwardly curved portion; and c) a support member engaging the bottom of the work surface and the wall when the work surface is in the deployed position so as to support the work surface in the deployed position, said support member being movable to a stowed position that allows the work surface to rotate to a storage position against the wall.

5. The folding workbench according to claim 4 wherein the support member is secured to the bottom of the workbench and rotates against the bottom of the workbench in the stowed position.

6. The collapsible bench according to claim 4 further including one or more tool supports mounted along a side of the work surface.

7. The collapsible bench according to claim 4 wherein the work surface includes a plurality of openings to permit debris and water to fall through said work surface.

8. A garden bench comprising:

a) a wall mounting structure adapted to be attached to a vertical surface, said wall mounting structure comprising:

i) a mounting bracelet comprising a planar portion and a sleeve, said planar portion adapted to be secured to the vertical surface with a fastener; and ii) a generally j-shaped hook including an upwardly curved portion and a shank, said shank received within said sleeve and rotatable therein along a vertical axis such that the upwardly curved portion may be positioned generally parallel to said planar portion in a stored position and normal to said planar portion in an active position;

b) a work bench including a top, a bottom, and a plurality of sides, said bench including a plurality of perforations extending from said top, through said bench to said bottom, at least one of said plurality of perforations adapted to slide over said upwardly curved portion such that said work bench is removably positioned on said wall mounting structure and further able to rotate on said upwardly curved portion between a horizontal active bench position and a vertical stored bench position;

c) at least one tool support mounted along a side of the work bench;

d) a support clamp attached to the bottom of the work bench;

e) a triangular support having a vertical member and a horizontal member, said horizontal member rotatably positioned within said support clamp such that said triangular support may be moved between an active support position and a stowed support position, wherein said vertical member is vertical in said active support position and flush against said bottom in said stowed support position; and f) whereby said work bench may be positioned on said wall mounting structure by moving said j-shaped hook to the active position and sliding one of said perforations thereon and subsequently the work bench may be moved to the active bench position by rotating said upwardly into a horizontal posture and unfolding said triangular support so that said support is in said active support position, and further the bench may be moved to a stowed bench position by folding said triangular support against the bottom of said bench and rotating said bench into a generally vertical stored posture.

* * * * *